US007305800B1

(12) United States Patent
Calfee

(10) Patent No.: US 7,305,800 B1
(45) Date of Patent: Dec. 11, 2007

(54) STORM BARRIER ASSEMBLY

(76) Inventor: Amy Lynn Calfee, 3736 Via de la Reina, Jacksonville, FL (US) 32217

( * ) Notice: Subject to any disclaimer, the term of this patent is extended or adjusted under 35 U.S.C. 154(b) by 456 days.

(21) Appl. No.: 10/823,028

(22) Filed: Apr. 13, 2004

(51) Int. Cl.
*E06B 5/10* (2006.01)
*E06B 5/12* (2006.01)

(52) U.S. Cl. ..... 52/203; 52/202; 52/DIG. 12; 49/463; 292/142; 292/256.5

(58) Field of Classification Search ..... 52/202, 52/203, DIG. 12, 507; 49/463, 57, 395, 49/449, 451; 292/142, 172, 39, DIG. 11, 292/256.5
See application file for complete search history.

(56) References Cited

U.S. PATENT DOCUMENTS

| | | | | | |
|---|---|---|---|---|---|
| 228,241 | A | * | 6/1880 | Zimmerman | 292/39 |
| 322,426 | A | * | 7/1885 | Cunningham | 292/39 |
| 702,198 | A | * | 6/1902 | Gibboney | 292/39 |
| 1,017,196 | A | * | 2/1912 | Baloian | 52/476 |
| 1,088,399 | A | * | 2/1914 | Bradshaw | 292/39 |
| 1,251,467 | A | * | 1/1918 | Blixt et al. | 109/61 |
| 1,413,704 | A | * | 4/1922 | Bresin | 49/463 |
| 1,515,454 | A | * | 11/1924 | Wilson | 49/463 |
| 1,548,882 | A | * | 8/1925 | Hemphill | 70/120 |
| 2,046,790 | A | * | 7/1936 | Phillips | 292/179 |
| 2,066,705 | A | * | 1/1937 | Vazquez | 70/118 |
| 2,238,754 | A | * | 4/1941 | Rupp | 49/72 |
| 2,274,854 | A | * | 3/1942 | Stewart | 292/160 |
| 2,315,692 | A | * | 4/1943 | Ditchfield | 220/1.5 |
| 2,431,105 | A | * | 11/1947 | Brinson | 292/172 |
| 2,720,393 | A | | 10/1955 | Valentine | |
| 2,771,313 | A | * | 11/1956 | Blake | 292/142 |
| 2,794,217 | A | * | 6/1957 | Croft | 248/200.1 |
| 3,098,611 | A | * | 7/1963 | Connell | 40/714 |
| 3,381,431 | A | * | 5/1968 | Jacobson | 52/309.1 |
| 3,665,737 | A | * | 5/1972 | Reese | 70/118 |
| 3,792,885 | A | * | 2/1974 | Giardina et al. | 292/39 |
| 3,947,060 | A | * | 3/1976 | Zimmer et al. | 292/142 |
| 3,978,554 | A | * | 9/1976 | Miller, Jr. | 52/712 |
| 4,475,311 | A | * | 10/1984 | Gibson | 49/176 |

(Continued)

FOREIGN PATENT DOCUMENTS

| | | | | |
|---|---|---|---|---|
| DE | 4326934 | * | 11/1994 | 52/202 |

(Continued)

*Primary Examiner*—Lanna Mai
*Assistant Examiner*—Phi Dieu Tran A
(74) *Attorney, Agent, or Firm*—Mark Young, P.A.

(57) ABSTRACT

An apparatus and assembly for retaining a substantially flat, protective panel within a frame such as a window frame. In one embodiment, the panel retention apparatus of the present invention includes a bracket member for fitting over an edge of the panel, such that the bracket member provides edge and lateral support for the panel. The apparatus further includes a rack and gear mechanism affixed to the bracket member. The rack and gear mechanism preferably includes a circular driving gear and a rack member having a foot member attached at one end and further having a rack gear engaging the circular driving gear such that the rack member is linearly movable with respect to the bracket member responsive to rotational actuation of the circular driving gear. In a preferred embodiment, the rack and gear mechanism components are fabricated of a Delrin composite material which provides a lightweight, corrosion resistant, and low surface friction actuation assembly.

6 Claims, 5 Drawing Sheets

U.S. PATENT DOCUMENTS

| | | | | | |
|---|---|---|---|---|---|
| 4,756,122 | A | * | 7/1988 | Snapka | 49/57 |
| 4,846,246 | A | * | 7/1989 | Stern | 160/224 |
| 5,054,837 | A | * | 10/1991 | Chapman | 296/24.4 |
| 5,117,585 | A | * | 6/1992 | Andrisin, III | 49/55 |
| 5,343,668 | A | * | 9/1994 | Gonzalez | 52/712 |
| 5,346,266 | A | * | 9/1994 | Bisbing | 292/64 |
| 5,347,775 | A | * | 9/1994 | Santos | 52/202 |
| 5,430,981 | A | * | 7/1995 | Scott | 52/202 |
| 5,927,769 | A | * | 7/1999 | Pullen | 292/169.13 |
| 6,029,401 | A | | 2/2000 | Gale | |
| 6,219,978 | B1 | | 4/2001 | Wood | |
| 6,233,877 | B1 | * | 5/2001 | Monroe | 52/37 |
| 6,330,768 | B1 | * | 12/2001 | Rodrigues | 52/202 |
| 6,334,282 | B1 | | 1/2002 | Wood | |
| 6,347,483 | B1 | * | 2/2002 | Andersen | 49/57 |
| 6,640,509 | B2 | | 11/2003 | Clewis | |

FOREIGN PATENT DOCUMENTS

| | | | | |
|---|---|---|---|---|
| GB | 2045321 | * | 10/1980 | 49/463 |
| GB | 2146377 | * | 4/1985 | 52/202 |
| JP | 3-169996 | * | 7/1991 | 49/463 |

* cited by examiner

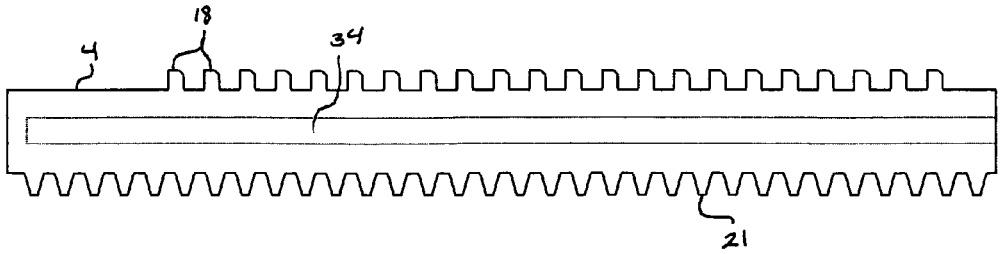
FIG. 2A
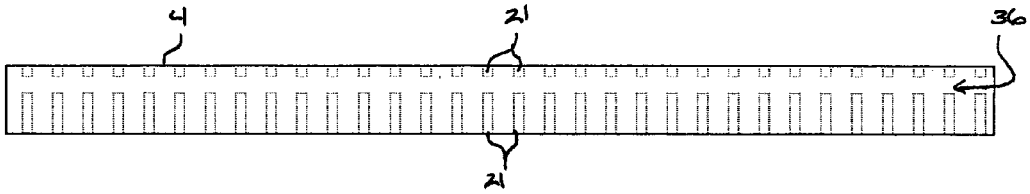
FIG. 2B
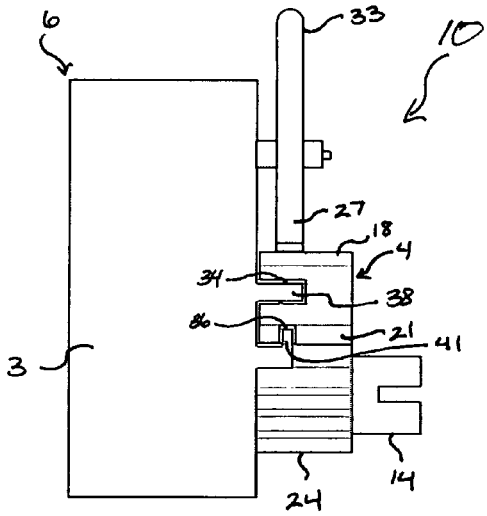
FIG. 3
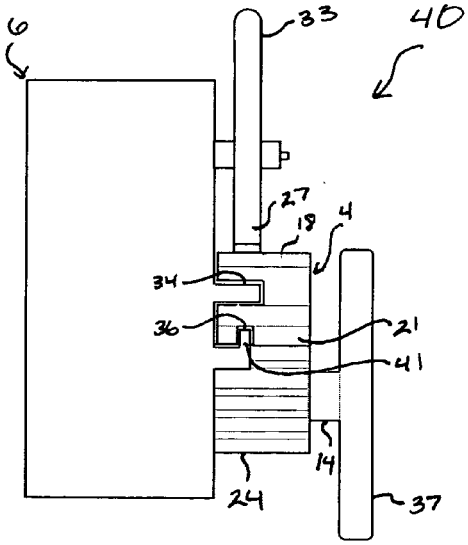
FIG. 4
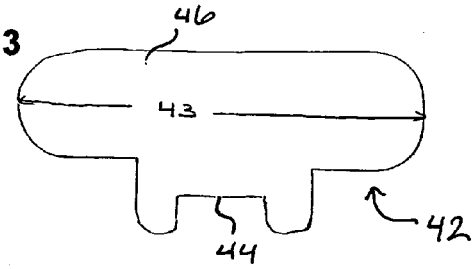

STORM BARRIER ASSEMBLY

BACKGROUND OF THE INVENTION

1. Technical Field

The present invention relates generally to devices for suspending a panel within a frame, such as a window frame. In particular, the present invention relates to a protective panel apparatus that may be temporarily installed within a frame. More particularly, the present invention relates to a panel retention device and a panel assembly employing the same that provide a protective barrier against winds and other environmental hazards.

2. Description of the Related Art

Glass doors and windows offer very little resistance to high winds and airborne debris. The breaching of a building portal such as a glass door or window causes a dramatic pressure increase inside the structure resulting in a catastrophic failure of the roof structure. The continual and unpredictable threat posed by hurricanes, tornadoes and other severe weather phenomena resulting in property damage and injury or loss of life in many regions of the world has therefore driven the development of many different types of window and door protection systems and devices. Among the most commonly used of such protective devices are removable panels and a variety of types of permanently installed protection shutters. While providing reliable storm protection, shutters and other permanently installed devices are expensive and are increasingly considered an unattractive feature on the exterior home or building décor.

Removable plywood paneling is perhaps the oldest and best-known type of fortification covering because of its widespread use when hurricane or other storms threaten populated regions. The installation of plywood panels, typically over windows and glass doors, is usually a do-it-yourself project with the plywood material available at most hardware or home improvement stores. The advantages of plywood panels are that they are portable and do not become a permanent fixture on the home or building. In addition, plywood panels are widely available and inexpensive.

A significant disadvantage of using temporary plywood panels is that it requires drilling or boring unsightly screw or nail holes in the frame structure surrounding the window to which the heavy cover panel is securely fastened. Given the natural reluctance of home and building owners to damage their outside property with such boreholes in the absence of dire necessity, many persons find themselves hurriedly attempting to install such panels in the period immediately prior to a forecasted storm. Under time pressures and possibly low light, or increasingly windy or otherwise hostile weather conditions, the installation of plywood panels over doors and windows is often haphazard, resulting in compromised barrier integrity and/or excessive damage to the window or door frames to which the panels are secured. Other drawbacks of using plywood panels include the considerable weight of large panels which further require storage and protection from moisture and wood-destroying insects.

Given the continued popularity of removable storm panels, solutions to some of the foregoing problems have been proposed, such as disclosed by U.S. Pat. Nos. 6,219,978 and 6,334,282 both issued to Wood. U.S. Pat. No. 6,219,978, entitled "Device For Covering Windows During Severe Storms" discloses a window barrier apparatus utilizing non-destructive means for securing a plywood panel within a window frame. Specifically, the apparatus employs a slide-arm-and-bolt assembly including a base plate clipped or otherwise secured to an edge of a panel, and a slide arm that extends therefrom and terminates at a rubber stopper for contacting an edge surface of a window frame. The means for extending the slide arm comprises a bolt that is advanced or retracted using a wrench or pliers such that the slide arm may first be fitted within the window frame and subsequently extended until the rubber stopper at the end of the slide arm exerts sufficient pressure against the window frame to securely anchor the panel.

A critical drawback in using the window protection device disclosed in U.S. Pat. No. 6,219,978 is that actuation of the slide-arm-and-bolt assembly described therein requires significant hand tool working, resulting in a relatively slow and cumbersome panel installation process. When installing a panel using such a device, for example, the helical extension and retraction of the extender bolt requires tool actuation in a rotational plane transverse to the panel surface plane and is therefore time consuming and inefficient in terms of obstructing the user's ability to quickly adjust to the correct tension by hand feel in the limited working volume adjacent the panel. U.S. Pat. No. 6,334,282 addresses some of these problems by replacing the slide-arm-and-bolt design with a spring-controlled locking arm assembly in which a lever arm is pre-positioned such that the rubber footer is initially in a withdrawn position. After positioning device within a window frame, the lever arm is released, resulting in the rubber stopper pivoting into position against the frame surface with the pressure applied by the spring. While eliminating the aforementioned drawbacks of the devices disclosed in U.S. Pat. No. 6,219,978, the obvious problem with this solution is the lack of means for selectively adjusting the pressure applied by the spring tensioned stoppers.

It can therefore be appreciated that a need exists for an improved panel suspension apparatus and method for using the same that may be quickly and easily installed in low light or otherwise hostile environmental conditions without damaging surrounding supporting structure and while providing adequate panel anchoring security. The present invention addresses such a need.

SUMMARY OF THE INVENTION

An apparatus and assembly for retaining a substantially flat, protective panel within a frame such as a window frame are disclosed herein. In one embodiment, the panel retention apparatus of the present invention includes a bracket member for fitting over an edge of the panel, such that the bracket member provides edge and lateral support for the panel. The apparatus further includes a rack and gear mechanism affixed to the bracket member. The rack and gear mechanism preferably includes a circular driving gear and a rack member having a foot member attached at one end and further having a rack gear engaging the circular driving gear such that the rack member is linearly movable with respect to the bracket member responsive to rotational actuation of the circular driving gear. In a preferred embodiment, the rack and gear mechanism components are fabricated of a Delrin composite material which provides a lightweight, corrosion resistant, and low surface friction actuation assembly.

All objects, features, and advantages of the present invention will become apparent in the following detailed written description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 2A illustrates a profile view of a rack member incorporated in a panel retention apparatus in accordance with the present invention;

FIG. 2B depicts an alternate profile view of the rack member shown in FIG. 2A;

FIG. 3 illustrates an alternate profile view of the panel retention apparatus of the present invention;

FIG. 4 depicts a profile view of a panel retention apparatus in accordance with an alternate embodiment of the present invention.

DETAILED DESCRIPTION OF A PREFERRED EMBODIMENT

The present invention is described in a preferred embodiment in the following description with reference to the figures. While this invention is described in terms of the best mode for achieving this invention's objectives, it will be appreciated by those skilled in the art that variations may be accomplished in view of these teachings without deviating from the spirit or scope of the present invention. Furthermore, when used and unless otherwise stated, the terms "horizontal," "vertical," "upper," "lower," "front," "back," "over," and "under," and similar position related terms are not to be construed as limiting the invention to a particular orientation. Instead, such terms are to be construed only on a relative basis with respect to the accompanying depicted embodiments.

The present invention is directed to an improved method and apparatus for protectively covering a window or other framed building portal or entryway that is quickly and easily installable and provides adequate impact and positive and negative pressure resistance. Specifically, the present invention provides a means for compressively suspending a panel, such as a plywood panel, within or over a window frame or similar framed structure in a manner facilitating fast and reliable hand installation. As explained and depicted in further detail with reference to the figures, the present invention may be embodied as a panel retention mechanism and/or a panel assembly incorporating one or more such panel retention mechanisms in which the one or more panel retention mechanisms include U-shaped brackets for engaging one or more edges of a panel. The one or more panel retention mechanisms further include extendable arm members that may be extended outwardly to apply a compressive force against a surface of the frame in or on which the assembly is installed. The means for extending and retracting the arm members preferably comprises a rack and gear mechanism uniquely designed to provide sufficient compressive panel retention traction while advantageously accommodating convenient user actuation in which the user actuates the mechanism in a rotational plane parallel to the panel side.

Figure 1A:
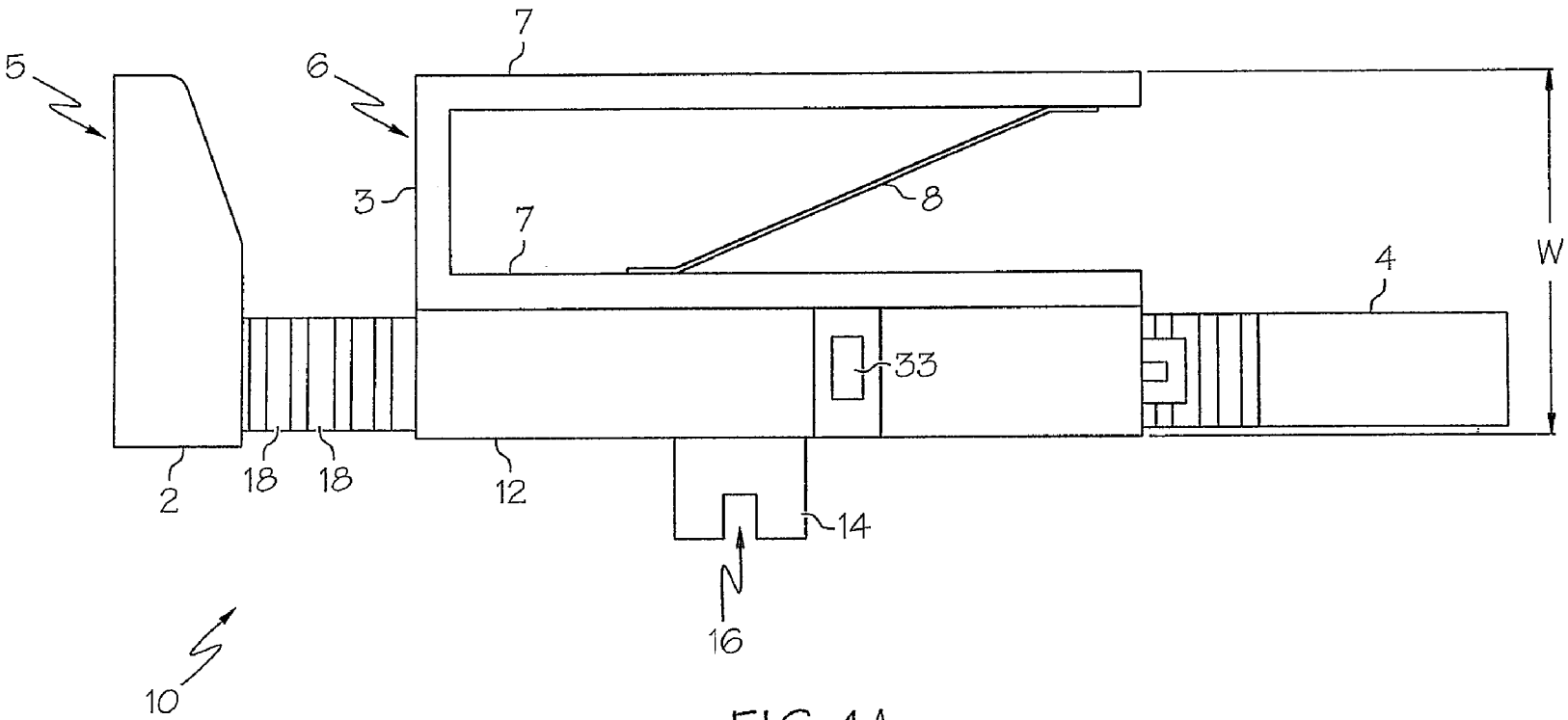
FIG. 1A depicts a side profile view of a panel retention apparatus in accordance with a preferred embodiment of the present invention.
Figure 1B:
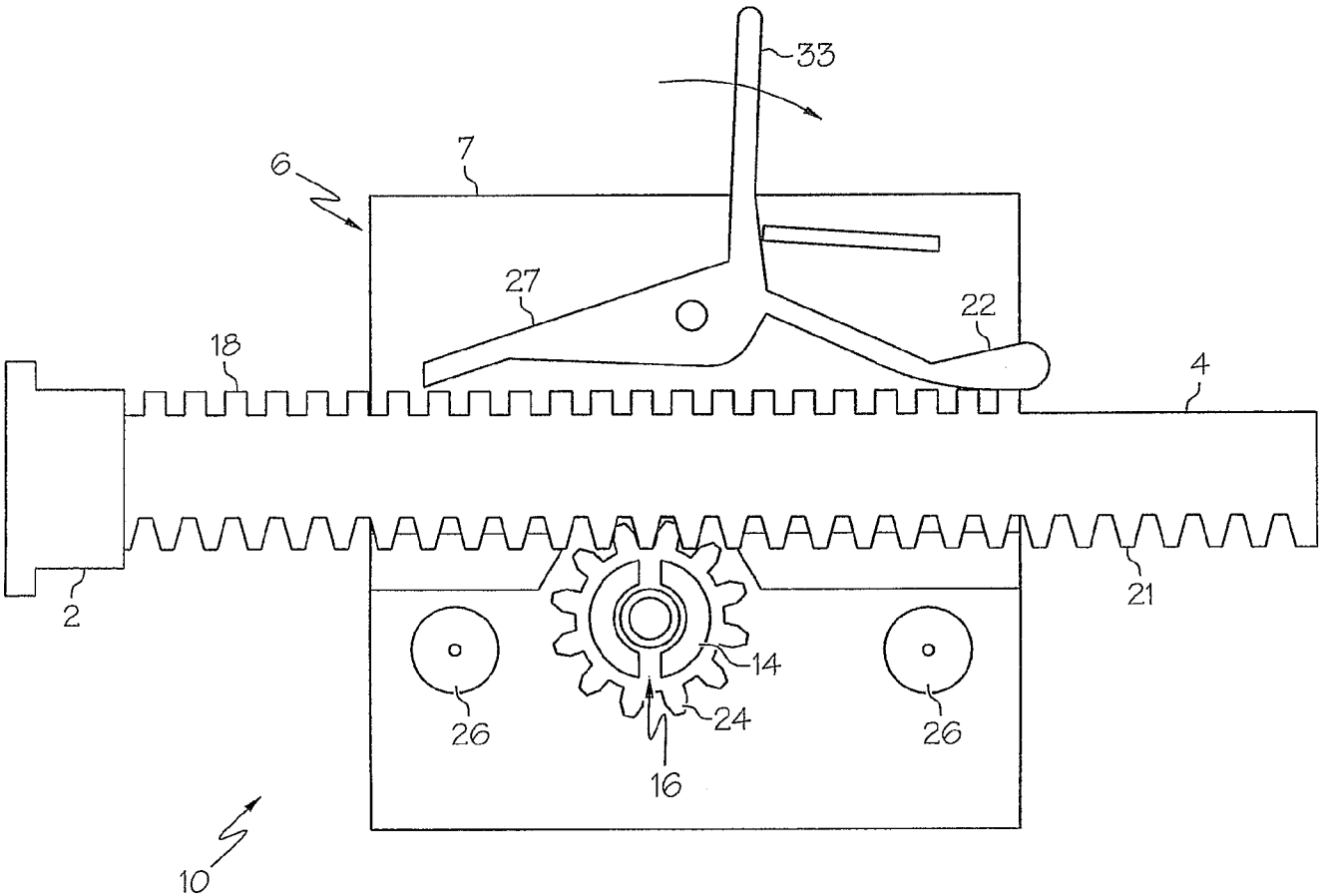
FIG. 1B illustrates a front profile view of a panel retention apparatus in accordance with a preferred embodiment of the present invention.
Figure 1C:
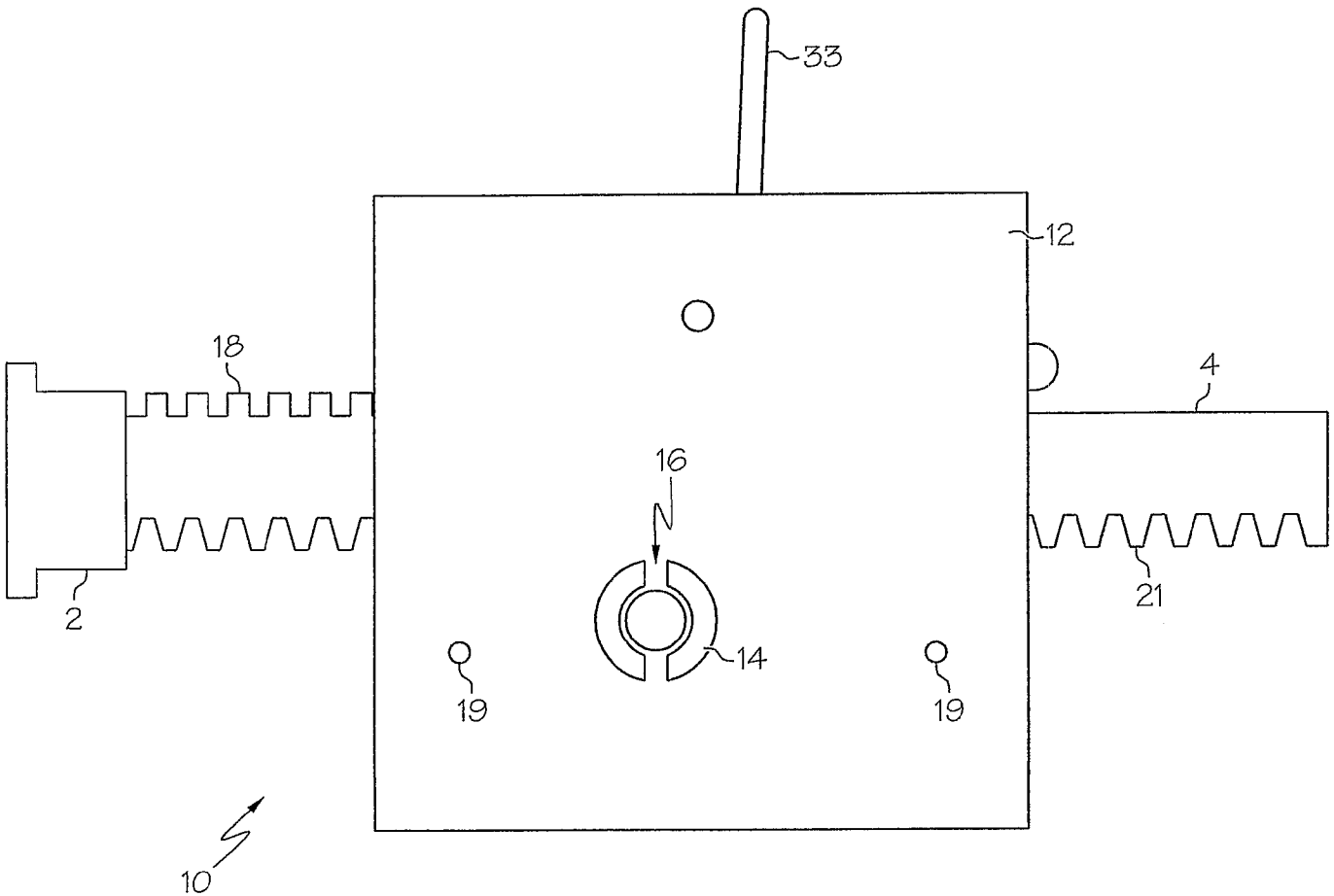
FIG. 1C depicts a fully assembled front profile view of the panel retention apparatus shown in FIGS. 1A and 1B.

With reference now to the figures, wherein like reference numerals refer to like and corresponding parts throughout, and in particular with reference to FIGS. 1A-1C there are depicted alternate profile views of a panel retention apparatus 10 in accordance with a preferred embodiment of the present invention. Panel retention apparatus 10 is designed such that one or more such mechanisms may be utilized to compressively anchor a substantially flat panel between at least two fixed points such as within an exterior window frame. As shown in FIG. 1A, panel retention apparatus 10 generally comprises a bracket member 6 that is fastened or integrally combined as a single unit with a gear housing cover 12 from which an extensible arm in the form of a rack member 4 is linearly extendable. Bracket member 6 is generally U-shaped, comprising a pair of opposing sidewalls 7 conjoined by a backwall 3, and is suitably sized and contoured for fitting over the edge of a panel (not depicted). In this manner, bracket member 6 provides edge and lateral side support for the panel. The inner sidewall 7 of bracket member 6 may be fastened or otherwise adhered to or may be formed as an integral wall of gear housing 12. As shown in the depicted embodiment, bracket member 6 preferably includes a flexible clip 8 for maintaining a stabilizing tension on the lateral panel side with the panel edge preferably resting in abutment with the inner surface of backwall 3. In this manner, bracket member 6 flexibly accommodates panels having differing edge widths.

As further depicted in FIGS. 1A and 1B, the inner sidewall 7 serves as a rack and gear mounting forum as more fully depicted and described with reference to FIGS. 1B, 2A, 2B, 3 and 4. A gear housing cover member 12 is preferably fastened to the rack and gear mounting site to provide substantial enclosure of the rack and gear components. Partially enclosed within gear housing cover 12, rack member 4 terminates at one end with a foot member 4. In practice, when utilizing panel retention apparatus 10 to brace a panel within a frame, a rack and gear mechanism enclosed by housing cover 12 is actuated to linearly advance the end of rack member 4 terminating with foot member 2 outwardly away from the bracket/housing unit until that foot member 2 contacts a surface of the frame. In this manner, an opposing force applied to an opposing side edge of the panel is transmitted and applied to the portion of foot member 2 contacting the frame surface. In accordance with the depicted embodiment, foot member 2 includes a toe end 5 that extends radially from the rack member axis toward the outwardly displaced sidewall member 7. In a preferred embodiment, the toe end 5 of foot member 2 extends such that its edge is substantially aligned with the outer sidewall 7. This relative disposition of bracket member 6, rack member 4 and foot member 2 may be advantageously deployed within a window frame, for example, such that toe end 5 extends inwardly to catch and contact a sufficient frame surface area while maintaining alignment with the edge of the object panel, resulting in optimal leverage alignment and maintaining the panel as close as possible to the framed object, such as a glass window.

The bottom (i.e. contacting) foot surface of foot member 2 is preferably constructed of a semi-flexible material, such as a rubberized material, exhibiting sufficient flexibility to facilitate footer surface contact friction with a frame surface. The footer material type and contouring is furthermore preferably selected to enable secure placement and compressive anchoring of the foot member 2 on a possibly uneven frame surface. Possibly contouring of the contact surface of foot member 2 include flat, ridged, rounded, etc.

Referring now to FIG. 1B in conjunction with FIG. 1A, an alternative profile view of panel retention apparatus 10 is depicted showing further detail of the rack and gear mechanism employed therein. Specifically, FIG. 1B illustrates a rack and gear mechanism generally comprising a spindle-mounted, rotatable circular driving gear 24 disposed in parallel to an inside mounting surface, which in the depicted embodiment is the inner sidewall of bracket member 6. As shown in FIG. 1B, driving gear is a spur-type gear having gear teeth extending radially outward along its outer circumference. The rack and gear mechanism further comprises rack member 4 having a linear rack gear 21 having gear teeth engaging the gear teeth of driving gear 24. The gear teeth of rack gear 21 and driving gear 24 are preferably shaped for smooth mutual engagement with minimal surface friction to minimize wear and maximize power transmission from the driving gear 24 to rack member 4.

Driving gear 24 further includes a coaxially disposed actuator drum 14 extending outwardly therefrom (i.e. extending outwardly from the depicted front side of the rack and gear mechanism). In accordance with the depicted embodiment, actuator drum 14 includes a diametric key slot 16 disposed across and through its distal end. Slot 16 provides an ideal leverage surface in which an actuator key (depicted in FIG. 3) can be fitted and utilized to manually apply a rotational actuation force for turning the coaxially affixed driving gear 24. The disposition of driving gear 24 as depicted in FIG. 1B results in a driving actuator having a rotary actuation plane that is parallel to the sidewalls of 7 and the panel retained therein, thus providing a user with ample space for hand and/or tool manipulation which maintaining an optimally compact design.

As illustrated in FIG. 1B, the rack and gear mechanism of the present invention further comprises a ratchet device for restricting bidirectional motion of rack member 4 with respect to the bracket/housing unit. Specifically, the ratchet device includes a row of ratchet teeth 18 disposed on a lengthwise side of rack member 4 and a ratchet arm member 27 that is forward biased by a flexible bias arm 22 to rest in a default repose in which the end of ratchet arm 27 engages ratchet teeth 18, preventing rack member 4 from retracting from an outwardly advanced position. A ratchet disengagement lever 33 is affixed in a lever-like relationship to ratchet arm 27 such that when lever 33 is pulled back in the indicated direction, ratchet arm 27 is released from engagement with ratchet teeth 18 thus enabling rack member 4 to be freely retracted with foot member 2 pulled back toward the bracket/housing unit.

FIG. 1C depicts a fully assembled front profile view of panel retention apparatus 10 in which gear housing cover 12 has been fastened over the lateral front side of the rack and gear mechanism and affixed to bracket member 6 via retainer screws 19 and screw ports 26. The individual and overall dimensions of the components of panel retention apparatus 10 are significant, particularly when the apparatus is deployed as in the relatively confined volume within a window frame. The assembled bracket/housing unit preferably has a combined width of between 2.5 and 3.5 cm for window frame applications in which the frame has a depth (i.e. gap between glass pane and outer frame edge) of between 2 and 6 cm. As shown in FIG. 1C, the distal end of actuator drum 14 extends through the front lateral side of gear housing cover 12 and is thus conveniently transversely hand-accessible.

The panel retention apparatus of the present invention further includes mechanical features resulting in a particularly advantageous compactness of design while maintaining the necessary structural robustness required for applying and/or withstanding the considerable compressive force required to maintain a panel within a window frame in a sufficiently secure manner to withstand the extreme pressure forces produced in severe storm conditions. To this end, and as depicted in FIGS. 2A and 2B, rack member 4 preferably includes a guide channel 34 disposed as a straight slot into and along one of its lateral sides defined between the ratchet teeth edge and rack gear edge 21. Guide channel 34 is preferably a smooth slot that receivably engages a bearing guide member (depicted in FIGS. 3 and 4) to provide vertical lengthwise stability of rack member 4 as the rack member moves linearly along the rack and gear mechanism. As illustrated in FIG. 2B, rack member 4 includes an additional and synergistically cooperative support feature in the form of a guide channel 36 disposed lengthwise into and along rack gear 21. Guide channel 36 is preferably contoured to receivably engage a bearing guide member (depicted in FIGS. 3 and 4) to provide horizontal lengthwise stability of rack member 4 as the rack member moves linearly along the rack and gear mechanism.

The multidirectional support bearing features employed by the present invention are depicted in the alternate profile depiction of panel retention apparatus 10 shown in FIG. 3. Specifically, FIG. 3 illustrates a profile view of panel retention apparatus 10 with foot member 2 removed to provide a clear representative profile view of the mutual dispositions of the assembled rack and gear components. A manual or automated rotational force applied to actuator drum 14 is translated to linear advancement of rack member 4 as the gear teeth of driving gear 24 engage the rack gear 21 of rack member 4. In a preferred embodiment, an actuator key 42 is utilized to translate a user's hand or finger pressure into a torque applied to actuator drum 14. Actuator key 42 is preferably a flat member constructed of metal or substantially rigid polymers or plastics and having a slot engagement edge 44 suitably contoured to be securely engaged into actuator slot 16 on actuator drum 14. Furthermore, actuator key 42 preferably includes a winged handle 46 that preferably has a minimum lever span 43 of at least twice the diameter of circular driving gear 24.

An alternative user actuation design is illustrated in FIG. 4, which depicts a panel retention apparatus 40 having the same bracket and rack and gear features but which differs from panel retention apparatus 10 by including an actuator wheel 37 for translating a user's hand or finger pressure into a torque applied via actuator drum 14 to driving gear 24. In accordance with the embodiment depicted in FIG. 4, actuator wheel 37 may be permanently fastened, adhered or integrally manufactured as a single unit with actuator drum 14 and/or driving gear 24. As with the relative dimension ratio between actuator key 42 and driving gear 24, the diameter of actuator wheel 37 is preferably selected to be at least twice the diameter of driving gear 24 resulting in at least a doubling of the original hand-applied torque.

As explained above, rack member 4 is linearly advancible with linear retraction inhibited in the opposing linear direction by the engagement of ratchet arm 27 with ratchet teeth 18 until lever arm 33 is manually pressed or pulled to lift and release the engagement of ratchet arm 27 with ratchet teeth 18. Given the relatively small desired component dimensions and the substantial force loads applied by these components, the present invention further includes strategically disposed support bearing features that enhance static and dynamic load-bearing stability of the apparatus while maintaining compactness of assembly design. Such support bearing features include guide channels 34 and 36 disposed on the lateral and gear tooth sides, respectively, of rack member 4 as illustrated in FIGS. 2A and 2B. Furthermore, as depicted in FIGS. 3 and 4, the rack member support bearing means further includes a vertical guide member 38 fixedly attached to the rack and gear mounting surface (inner bracket sidewall 7 in the depicted embodiment) and extending outwardly therefrom in a horizontally planar manner to engage lateral guide channel 34 and provide vertical lengthwise bearing support for rack member 4. Another support member comprises a horizontal guide member 41 that is fixedly attached to the same mounting surface and is contoured in a flanged "L-shaped" manner such that it extends outwardly and upwardly to engage guide channel 36 and provide horizontal lengthwise bearing support for rack member 4.

Figure 5:
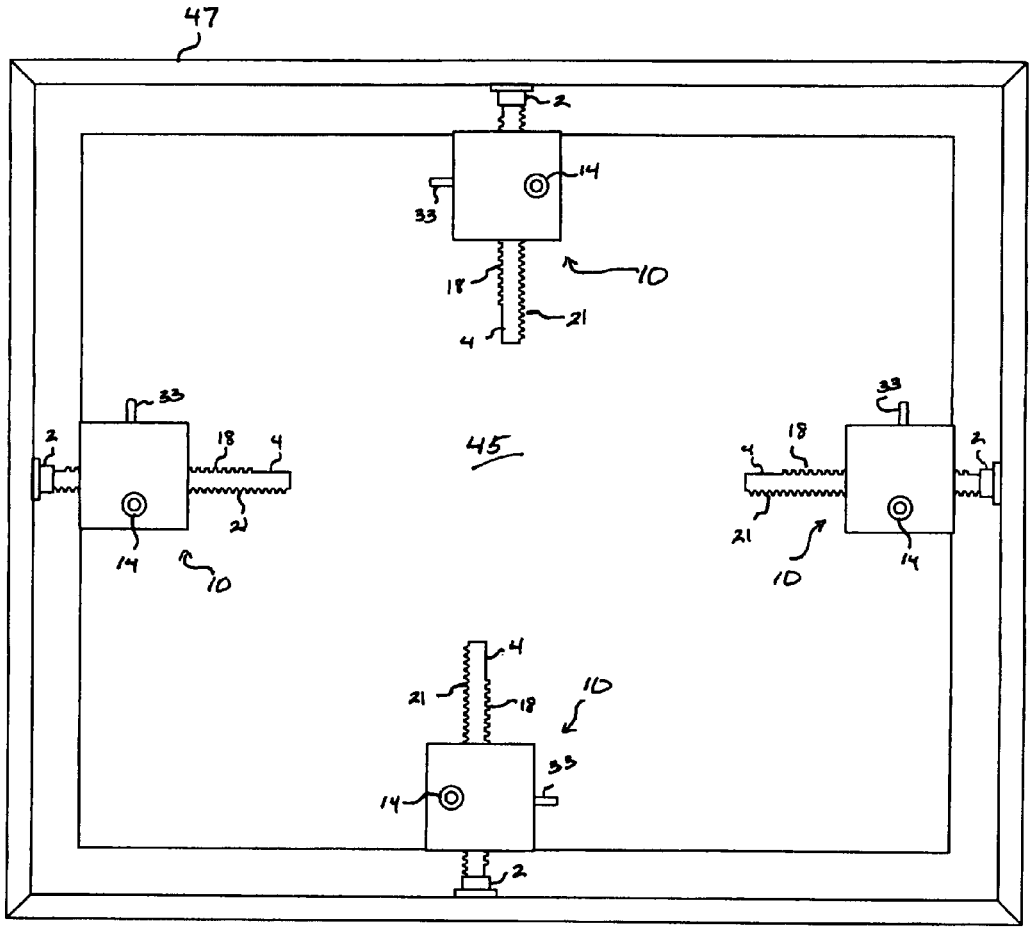
FIG. 5 illustrates a protective panel barrier assembled and installed in accordance with the present invention.

Referring to FIG. 5, there is illustrated a protective panel barrier assembly in accordance with the present invention. The panel barrier assembly generally comprises a substantially flat panel member 45 together with four panel retention devices 10 positioned on each of the four side edges of panel member 45. As shown in FIG. 5, retention devices 10 are arranged in mutually opposing positions on the side edges of panel 45 to compressively anchor or secure panel member 45 with a window frame 47. In view of the features characteristic of retention devices 10, the panel barrier assembly depicted in FIG. 5 may be conveniently installed or removed by a single user without the need for hand tools. It should be noted that while the depicted embodiment employs two pairs of mutually opposed retention devices, other configurations for deploying one or more such retention devices may be utilized without departing from the spirit or scope of the present invention.

For enhanced efficiency and structural integrity while maintaining a small and lightweight design, and in a preferred embodiment, the constituent components of panel retention devices 10 described above, including bracket 6, rack member 4, and driving gear 24 are preferably constructed of a strong, lightweight, corrosion resistant, and low friction material in the form of a composite polymer such as the Delrin composites owned by DuPont. Delrin is comparable in strength to many industry standard grades of steel without the susceptibility to corrosion and furthermore offers a much smoother and effectively self-lubricating surface that greater enhances efficiency and reduces component wear.

While this invention has been described in terms of several embodiments, it is contemplated that alterations, permutations, and equivalents thereof will become apparent to one of ordinary skill in the art upon reading this specification in view of the drawings supplied herewith. It is therefore intended that the invention and any claims related thereto include all such alterations, permutations, and equivalents that are encompassed by the spirit and scope of this invention.

What is claimed is:

1. A panel barrier assembly for providing a panel barrier within a framed volume, said panel barrier assembly comprising:

a substantially flat panel for providing a barrier within the framed volume; and at least one panel retention device for compressively securing said panel against at least two opposing frame surface areas such that the panel is securely suspended within the framed volume, said at least one panel retention device comprising:

a substantially U-shaped bracket member fitted over an edge of the panel; and a rack and gear mechanism affixed to said bracket member, said rack and gear mechanism comprising:

a driving gear;

a rack member having a foot member attached at one end and further having a rack gear engaging said driving gear such that said rack member is linearly movable with respect to said bracket member responsive to rotational actuation of said driving gear; and ratchet means restricting bidirectional linear motion of said rack member with respect to said bracket member, wherein said ratchet means comprises:

a row of ratchet teeth on a lengthwise side surface of said rack member; and a ratchet arm member engaging the ratchet teeth to allow advancement of said rack member in a linear direction in which a foot member affixed to one end of said rack member extends outwardly away from said bracket member and inhibits retraction of said rack member in the opposing linear direction.

2. The panel barrier assembly of claim 1, wherein said driving gear is a spur gear having a rotary actuation plane parallel to the panel.

3. The panel barrier assembly of claim 1, wherein said rack and gear mechanism is fabricated from a composite polymer.

4. The panel barrier assembly of claim 3, wherein said composite polymer comprises Delrin.

5. A panel barrier assembly for providing a panel barrier within a framed volume, said panel barrier assembly comprising:

a substantially flat panel for providing a barrier within the framed volume; and at least one panel retention device for compressively securing said panel against at least two opposing frame surface areas such that the panel is securely suspended within the framed volume, said at least one panel retention device comprising:

a substantially U-shaped bracket member fitted over an edge of the panel; and a rack and gear mechanism affixed to said bracket member, said rack and gear mechanism comprising:

a driving gear;

a rack member having a foot member attached at one end and further having a rack gear engaging said driving gear such that said rack member is linearly movable with respect to said bracket member responsive to rotational actuation of said driving gear; and support bearing means for providing vertical lengthwise bearing support and horizontal lengthwise bearing support for said rack member, wherein said support bearing means comprises:

a vertical bearing guide channel disposed lengthwise along a lateral side of said rack member; and a vertical guide member fixedly attached to said bracket and having a guide flange engaged into said vertical bearing guide channel.

6. A panel barrier assembly for providing a panel barrier within a framed volume, said panel barrier assembly comprising:

a substantially flat panel for providing a barrier within the framed volume; and at least one panel retention device for compressively securing said panel against at least two opposing frame surface areas such that the panel is securely suspended within the framed volume, said at least one panel retention device comprising:

a substantially U-shaped bracket member fitted over an edge of the panel; and a rack and gear mechanism affixed to said bracket member, said rack and gear mechanism comprising:

a driving gear;

a rack member having a foot member attached at one end and further having a rack gear engaging said driving gear such that said rack member is linearly movable with respect to said bracket member responsive to rotational actuation of said driving gear; and support bearing means for providing vertical lengthwise bearing support and horizontal lengthwise bearing support for said rack member, wherein said support bearing means comprises:

a horizontal bearing guide channel disposed lengthwise along said rack gear; and a horizontal guide member fixedly attached to said bracket and having a guide flange engaged into said horizontal bearing guide channel.

* * * * *